US005485250A

United States Patent [19]

Kashimura et al.

[11] Patent Number: 5,485,250

[45] Date of Patent: Jan. 16, 1996

[54] ELECTROPHOTOGRAPHIC APPARATUS WITH PHOTOSENSITIVE MEMBER HAVING SURFACE LAYER OF BINDER RESIN AND FLUORO AND/OR SILICON COMPOUND PARTICLES

[75] Inventors: Noboru Kashimura, Tokyo; Harumi Sakoh, Kawasaki; Kazushige Nakamura, Yokohama; Shoji Amamiya, Kawasaki; Takashige Kasuya, Soka; Haruyuki Tsuji, Yokohama; Masaaki Yamagami, Yokohama; Tatsuya Ikezue, Yokohama, all of Japan

[73] Assignee: Canon Kabushiki Kaisha, Tokyo, Japan

[21] Appl. No.: 289,269

[22] Filed: Aug. 11, 1994

Related U.S. Application Data

[62] Division of Ser. No. 114,925, Sep. 2, 1993, Pat. No. 5,357,320.

[30] Foreign Application Priority Data

| | | | |
|---|---|---|---|
| Sep. 4, 1992 | [JP] | Japan | 4-260627 |
| Sep. 4, 1992 | [JP] | Japan | 4-260628 |
| Sep. 4, 1992 | [JP] | Japan | 4-260629 |
| Sep. 4, 1992 | [JP] | Japan | 4-260630 |

[51] Int. Cl.[6] ..... G03G 5/00

[52] U.S. Cl. ..... 355/211; 430/66; 430/67

[58] Field of Search ..... 355/211; 430/66, 430/67

[56] References Cited

U.S. PATENT DOCUMENTS

| | | | |
|---|---|---|---|
| 4,863,823 | 9/1989 | Hiro et al. | 430/58 |
| 4,877,701 | 10/1989 | Hiro et al. | 430/59 |
| 5,114,814 | 5/1992 | Sakoh et al. | 430/46 |
| 5,273,851 | 12/1993 | Takei et al. | 430/66 |
| 5,284,730 | 2/1994 | Takei et al. | 430/66 |
| 5,357,320 | 10/1994 | Kashimura et al. | 355/211 |

FOREIGN PATENT DOCUMENTS

| | | |
|---|---|---|
| 0300426 | 1/1989 | European Pat. Off. . |
| 0501517 | 9/1992 | European Pat. Off. . |
| 2602064 | 1/1988 | France . |
| 3708512 | 10/1987 | Germany . |

OTHER PUBLICATIONS

Patent Abstracts of Japan, vol. 16, No. 078 (P1317), Feb. 1992 for JPA 03-266860.

European Search Report.

*Primary Examiner*—William J. Royer

*Attorney, Agent, or Firm*—Fitzpatrick, Cella, Harper & Scinto

[57] ABSTRACT

An electrophotographic apparatus is disclosed which has an electrophotographic photosensitive member and a transfer device. The photosensitive member has a conductive support and a photosensitive layer, and further has a surface layer formed of a binder resin, fluorine atom- or silicon atom-containing compound particles incompatible with the binder resin, and a fluorine atom- or silicon atom-containing compound compatible with the binder resin. In the surface layer, the proportion of fluorine atoms and silicon atoms to carbon atoms, (F+Si)/C, as measured by X-ray photoelectron spectroscopy is 0.01 to 1.0. Additionally, the transfer device is a multiple-transfer device.

6 Claims, 4 Drawing Sheets

ELECTROPHOTOGRAPHIC APPARATUS WITH PHOTOSENSITIVE MEMBER HAVING SURFACE LAYER OF BINDER RESIN AND FLUORO AND/OR SILICON COMPOUND PARTICLES

This application is a division of application Ser. No. 08/114,925 filed Sep. 2, 1993, now U.S. Pat. No. 5,357,320.

BACKGROUND OF THE INVENTION

1. Field of the Invention

This invention relates to an electrophotographic apparatus, and more particularly to an electrophotographic apparatus having a specific electrophotographic photosensitive member and a specific transfer means.

2. Related Background Art

Inorganic materials such as zinc oxide, selenium, and cadmium sulfide are hitherto known as photoconductive materials used in electrophotographic photosensitive members. Organic materials including polyvinyl carbazole, phthalocyanine and azo pigments have attracted notice based on the advantages that they promise high productivity and are free from environmental pollution, and have been put into wide use although they tend to be inferior to the inorganic materials in respect of photoconductive performance or running performance. In recent years, new materials having overcome such disadvantages have been studied, and are surpassing the inorganic materials particularly with regard to photoconductive performance.

Meanwhile, electrophotographic photosensitive members are required to have various chemical and physical durabilities since they are repeatedly affected by charging, exposure, development, transfer, cleaning and charge elimination in electrophotographic processes in copying machines or laser beam printers. In particular, surface properties of photosensitive members, such as surface energy, are concerned in developer transfer performance on photosensitive members, contamination of photosensitive members and so forth, and are one of the important factors for obtaining high-quality images. Most of the above organic photoconductive materials have no film forming properties by themselves, and hence they are commonly formed into films in combination with binder resins or the like when photosensitive layers are formed. Accordingly, properties of :such binder resins can be referred to as a factor that greatly influences the surface properties such as surface energy.

Binder resins conventionally used include polyester, polyurethane, polyarylate, polyethylene, polystyrene, polybutadiene, polycarbonate, polyamide, polypropylene, polyimide, polyamidoimide, polysulfone, polyallyl ether, polyacetal, nylon, phenol resins, acrylic resins, silicone resins, epoxy resins, urea resins, allyl resins, alkyd resins and butyral resins. However, those having better surface properties are being studied.

Incidentally, in recent years, there is a demand for electrophotographic processes that can faithfully reproduce color images, and several systems have been proposed. Among them, apparatus employing a multiple-transfer system are commonly available, in which a photosensitive drum and a transfer drum that carries a transfer material such as transfer paper are synchronized drum-to-drum and images corresponding to the three primary colors or four colors comprised of these three colors and a black color added thereto are successively superimposed on the transfer material to reproduce a color image.

One of the problems involved in such a process, is the transfer efficiency of the second and subsequent colors at the time of multiple transfer has been questioned. More specifically, the transfer of the second and subsequent colors is carried out via a developer which has already been transferred to a transfer material, and hence such transfer can only more indirectly operate than usual transfer. As a result, the developer which has not been transferred and is standing on the photosensitive member can not be transferred to the side of the transfer material, so only low-quality images can be obtained because of faulty transfer. Especially when the aforesaid conventional organic photosensitive members are used, faulty copying such as uneven transfer at solid image areas or letter blank areas caused by poor transfer tends to occur.

As another problem, the driving load of photosensitive members has been questioned. In particular, the step of cleaning to remove the developer remaining on the photosensitive member after transfer has a great influence on the driving load. As a cleaning method, blade cleaning should be employed so that the construction of the apparatus can be made simpler and more effective and the space for the apparatus can be saved. Blade cleaning usually takes a simple construction in which a platelike elastic member made of polyurethane or the like is brought into push contact with the surface of the photosensitive member in the direction of its generatrix. In the case when, however, the aforesaid conventional organic photosensitive members are used, a great contact energy is produced between the photosensitive member and the blade, so that a heavy load is applied to the driving of the photosensitive member. As a result, a disturbance such as uneven drive may occur in the driving of the photosensitive member which causes color misregistration wherein images corresponding to the second and subsequent colors are misregistered at the time of multiple transfer, or faulty copying such as drive pitch unevenness wherein the uneven drive comes out as an uneven image density. In particular, in apparatus in which as a light source for forming a latent image a laser, an LED or a liquid crystal shutter is used to form a dotlike minute latent image, the color misregistration on the micron order may easily occur unless the dots are superimposed at a high precision at the time of multiple transfer, to cause aberration of color tones, a decrease in image sharpness, etc.

SUMMARY OF THE INVENTION

An object of the present invention is to solve the problems discussed above and provide an electrophotographic apparatus that can always obtain images with a superior quality.

To achieve the object, the present invention provides an electrophotographic apparatus comprising an electrophotographic photosensitive member and a transfer means, wherein;

said electrophotographic photosensitive member comprises a conductive support having on its surface a photosensitive layer, and said electrophotographic photosensitive member has a surface layer comprised of a binder resin, fluorine atom- or silicon atom-containing compound particles incompatible with the binder resin, and a fluorine atom- or silicon atom-containing compound compatible with the binder resin; the proportion of fluorine atoms and silicon atoms to carbon atoms, (F+Si)/C, in said surface layer as measured by X-ray photoelectron spectroscopy being from 0.01 to 1.0; and said transfer means comprises a multiple-transfer means.

DESCRIPTION OF THE PREFERRED EMBODIMENTS

Figure 1:
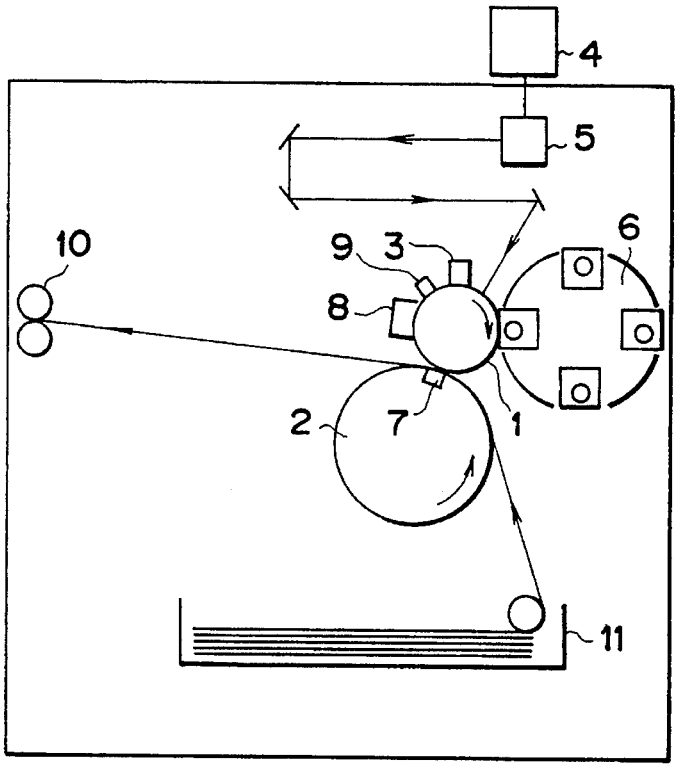
FIG. 1 schematically illustrates the construction of an electrophotographic apparatus used in Examples of the present invention.
Figure 2:
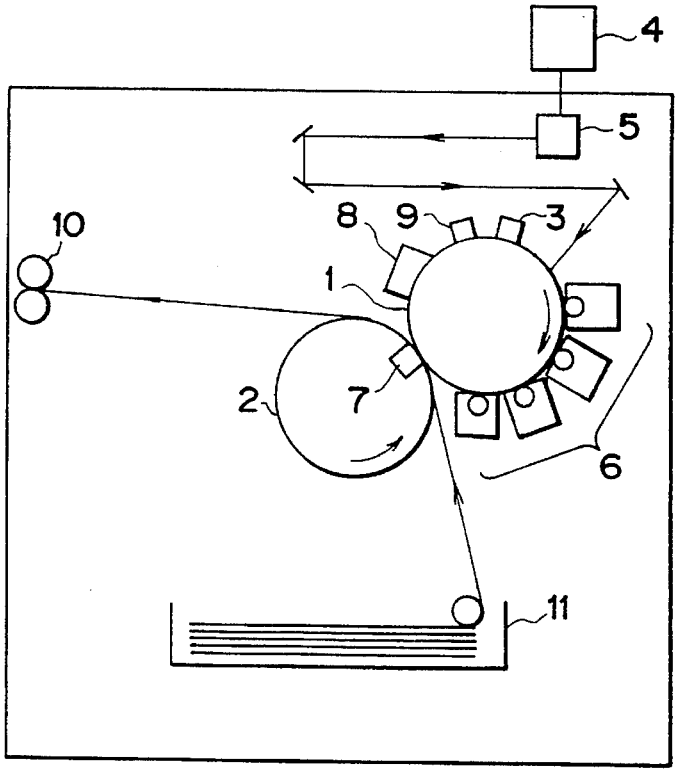
FIG. 2 schematically illustrates the construction of an electrophotographic apparatus usable in the present invention.
Figure 3:
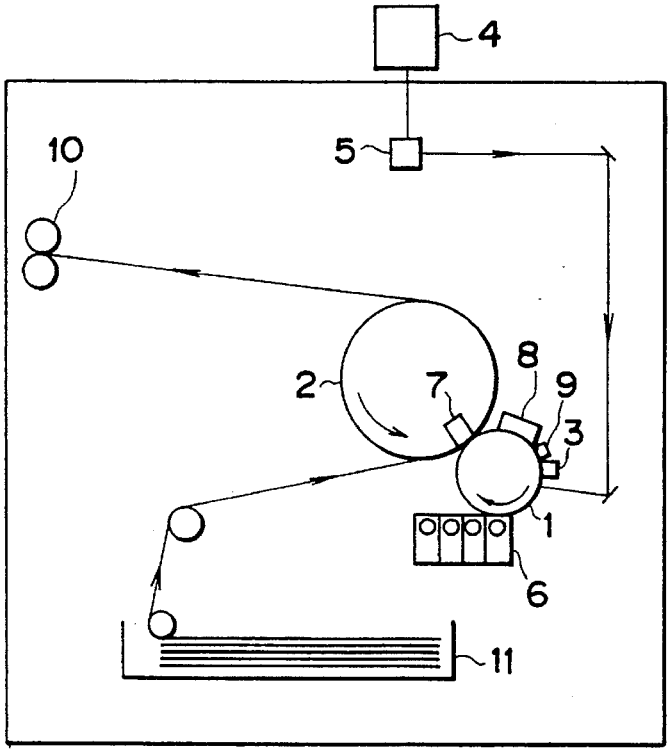
FIG. 3 schematically illustrates the construction of another electrophotographic apparatus usable in the present invention.

As mentioned above, the present invention is electrophotographic apparatus comprising an electrophotographic photosensitive member and a transfer means, wherein the electrophotographic photosensitive member comprises a conductive support having on its surface a photosensitive layer, and the electrophotographic photosensitive member has a surface layer comprised of a binder resin, fluorine atom- or silicon atom-containing compound particles incompatible with the binder resin, and a fluorine atom- or silicon atom-containing compound compatible with the binder resin; the proportion of fluorine atoms and silicon atoms to carbon atoms, (F+Si)/C, in the surface layer as measured by X-ray photoelectron spectroscopy being from 0.01 to 1.0; and the transfer means comprises a multiple-transfer means.

In the present invention, if the (F+Si)/C is less than 0.01, faulty images may be caused by unsatisfactory transfer or uneven drive. If it is more than 1.0, the strength or adhesion of the layer itself may become low or images may deteriorate because of light scattering caused by the compound particles.

The (F+Si)/C is of course influenced by the type or amount of the material used, and besides may have different values depending on the state of dispersion of particles or the state of surface of the photosensitive member.

The fluorine atom-containing compound used in the present invention may include graphite fluoride, and polymers and copolymers of tetrafluoroethylene, hexafluoropropylene, trifluoroethylene, chlorotrifluoroethylene, vinylidene fluoride, vinyl fluoride and perfluoroalkyl vinyl ethers, and graft polymers or block polymers containing any of these in the molecule. The silicon atom-containing compound may include monomethylsiloxane three-dimensional cross-linked products, dimethylsiloxane-monomethylsiloxane three-dimensional cross-linked products, ultrahigh-molecular weight polydimethylsiloxane, block polymers, graft polymers, surface active agents or macromonomers containing a polydimethylsiloxane segment, and terminal-modified polydimethylsiloxanes.

In the present invention, the compound particles incompatible with the binder resin described later and the compound compatible with it are selected from these materials and used in combination. The compound particles may preferably have a particle diameter of from 0.01 to 5 μm, and particularly preferably from 0.01 to 0.35 μm, as weight average particle diameter. The compound particles may also preferably have a molecular weight of from 3,000 to 5,000,000 as weight average molecular weight. The compound particles may still also preferably be contained in an amount of from 10 to 70% by weight, and particularly preferably from 20 to 60% by weight, based on the total weight of the layer containing the compound particles. The compound compatible with the binder resin may preferably be contained in an amount of from 0.1 to 50% by weight, and particularly preferably from 0.1 to 30% by weight, based on the total weight of the compound particles in the layer containing the compound.

The photosensitive layer of the electrophotographic photosensitive member used in the present invention has a structure of a single layer or multiple layers. In the case of the single-layer structure, carriers are produced and moved in the same layer, and the compound containing fluorine atoms or silicon atoms is contained in this layer which is an outermost layer. In the case of the multiple-layer structure, a charge generation layer in which carriers are produced and a charge transport layer in which carriers are moved are provided layer by layer. The layer that forms the surface layer may be either the charge generation layer or the charge transport layer. In either case, the fluorine atom- or silicon atom-containing compound is contained in the later that forms an outermost later.

The single-layer type photosensitive later may preferably have a layer thickness of from 5 to 100 μm, and particularly preferably from 10 to 60 μm. A charge-generating material that generates carriers or a charge-transporting material that transports carriers may preferably be contained in an amount of from 20 to 80% by weight, and particularly preferably from 30 to 70% by weight, based on the total weight of the photosensitive layer. In the case of the multiple-layer type photosensitive layer, the charge generation layer may preferably have a layer thickness of from 0.001 to 6 μm, and particularly preferably from 0.01 to 2 μm. The charge-generating material may preferably be contained in an amount of from 10 to 100% by weight, and particularly preferably from 40 to 100% by weight, based on the total weight of the charge generation later. The charge transport later may preferably have a layer thickness of from 5 to 100 μm, and particularly preferably from 10 to 60 μm. The charge-transporting material may preferably be contained in an amount of from 20 to 80% by weight, and particularly preferably from 30 to 70% by weight, based on the total weight of the charge transport layer.

The charge-generating material used in the present invention may include phthalocyanine pigments, polycyclic quinone pigments, azo pigments, perylene pigments, indigo pigments, quinacridone pigments, azlenium salt dyes, squarilium dyes, cyanine dyes, pyrylium dyes, thiopyrylium dyes, xanthene coloring metter, qunoneimine coloring matter, triphenylmethane coloring matter, styryl coloring matter, selenium, selenium-tellurium, amorphous silicon and cadmium sulfide. The charge-transporting material used in the present invention may include pyrene compounds, carbazole compounds, hydrazone compounds, N,N-dialkylaniline compounds, diphenylamine compounds, triphenylamine compounds, triphenylmethane compounds, pyrazoline compounds, styryl compounds end stilbene compounds.

These materials are dispersed or dissolved in a suitable binder resin when used. Such a binder resin preferably includes polyester, polyurethane, polyarylate, polyethylene, polystyrene, polybutadiene, polycarbonate, polyamide, polypropylene, polyimide, polyamidoimide, polysulfone, polyallyl ether, polyacetal, nylon, phenol resins, acrylic resins, silicone resins, epoxy resins, urea resins, allyl resins, alkyd resins and butyral resins. It is also preferable to use a reactive epoxy resin and an acrylic or methacrylic monomer or oligomer which have been mixed in the above resin and thereafter cured. Of these, polyarylate, polycarbonate and polyallyl ether are particularly preferred.

In the present invention, it is more preferable for the electrophotographic photosensitive member to have a protective layer on its photosensitive layer. The protective layer may preferably have a layer thickness of from 0.01 to 20 μm, and particularly preferably from 0.1 to 10 μm. The protective layer may contain the charge-generating material or charge-transporting material described above. In this case, the fluorine atom- or silicon atom-containing compound is also contained at least in the protective layer which is an outermost surface layer. Binder resins usable in the protective layer may include the same resins as the resin usable in the photosensitive layer described above.

The fluorine atom- or silicon atom-containing compound used in the present invention is dispersed or dissolved in the binder resin when used. It may be dispersed by means of a sand mill, a ball mill, a roll mill, a homogenizer, a nanomizer, a paint shaker, an ultrasonic wave or the like.

A subbing layer may be provided between the conductive support and the photosensitive layer. The subbing layer is mainly comprised of a resin, and may also contain the above conductive material or an acceptor-type substance. The resin that forms the subbing layer may include polyester, polyurethane, polyarylate, polyethylene, polystyrene, polybutadiene, polycarbonate, polyamide, polypropylene, polyimide, polyamidoimide, polysulfone, polyallyl ether, polyacetal, nylon, phenol resins, acrylic resins, silicone resins, epoxy resins, urea resins, allyl resins, alkyd resins and butyral resins.

These layers are each formed on the conductive support by bar coating, knife coating, roll coating, spray coating, dip coating, electrostatic coating or powder coating.

Materials for the conductive support used in the electrophotographic photosensitive member of the present invention may include metals such as iron, copper, nickel, aluminum, titanium, tin, antimony, indium, lead, zinc, gold and silver, alloys of any of these, oxides thereof, carbon, conductive resins, and also resins in which any of these conductive material have been dispersed. The conductive support may have any shape such as a cylinder, a belt or a sheet, and preferably has a shape depending on the electrophotographic apparatus used.

FIGS. 1 to 4 each schematically illustrate the construction of the electrophotographic apparatus in the present invention. In FIG. 1, reference numeral 1 denotes a drum-type electrophotographic photosensitive member, and 2 denotes a transfer drum. The photosensitive member and the transfer drum may be driven in the manner interlocked with a gear, a belt or the like or may have driving systems independent of each other, either case of which is available. In either case, the photosensitive member 1 and the transfer drum 2 are so controlled as to be synchronized each other since the second-color and subsequent color image(s) must be superimposed on the first-color image. In the example shown in FIG. 1, three-color or four-color developing means are provided in the manner rotarily movable to the photosensitive member. This electrophotographic apparatus can be used as an output device such as a copying machine, a printer and a facsimile machine.

Figure 4:
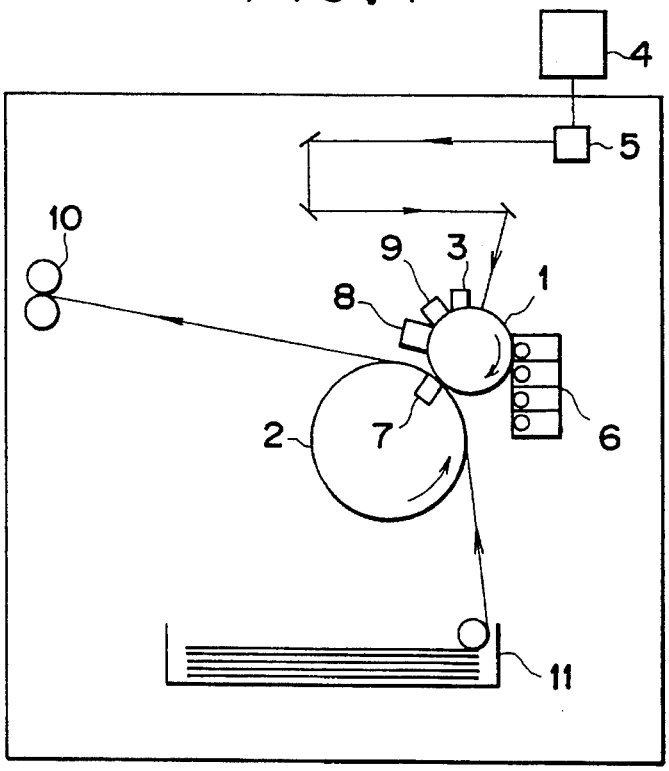
FIG. 4 schematically illustrates the construction of still another electrophotographic apparatus usable in the present invention.

The image formation is basically carried out according to the steps of charging, exposure, development, transfer, cleaning and charge elimination in this order. These steps are successively repeated to superimpose colors to reproduce a color image. First, charges are given to the surface of the photosensitive member by means of a corona charger 3 such as a corotoron or a scorotoron, and thereafter a dotlike minute optical image is shed on the photosensitive member from a light source 5 such as a laser, an LED or a liquid crystal shutter controlled by digital image signals sent from a reading device or an information processing memory medium 4 such as a computer. This optical image generates charge carriers in the photosensitive member, and a dotlike minute electrostatic latent image is formed as a result of elimination of surface charges on the photosensitive member. The image signals are color-separated into three colors of cyan, magenta and yellow or into four colors comprised of these three colors and a black color added thereto. After electrostatic latent images corresponding to the respective colors have been formed, they are successively developed by means of developing means 6 corresponding to the respective colors. Three-color or four-color developing means are disposed in the manner as shown in FIG. 1, and besides may be disposed according to a fixed system in which they are arranged along the photosensitive member (FIG. 2), or according to a movement system in which they are successively brought into contact with the photosensitive member by lateral movement (FIG. 3) or vertical movement (FIG. 4). The present invention can be applied to any of these systems.

The images developed by developers are transferred to a transfer material such as transfer paper in the step of transfer carried out by a transfer means 7. Since three-color or four-color images are multiple-transferred to a sheet of transfer material, the transfer material is electrostatically or mechanically secured to the surface of a transfer drum 2. In order to cause no misregistration of the respective colors at the time of transfer, the image start points and image areas of the photosensitive member 1 and the transfer drum 2 are always synchronizingly controlled at least in the course of the multiple transfer of the same image to the same transfer material. As a transfer means for transferring the developer from the photosensitive member to the transfer material, a corotoron, a scorotoron, a conductive brush or a conductive roller is used mainly utilizing an electrostatic force with a polarity reverse to that of the developer. At the same time, a pressure member is often used in combination in order to impart a transfer effect attributable to application of pressure. The transfer drum 2 is commonly comprised of a cylindrical frame member provided with a film or a mesh stretched in a cylindrical form so that the transfer material can be supported. Such a film and a mesh may be made of a resin of various types such as polyethylene terephthalate, polycarbonate, polyester, polysulfone, polyarylate, polyphenylene oxide, polyimide, polyamide, nylon, polyethylene oxide, polystyrene and polyacetal, and a polymer alloy containing any of these. The film and the mesh may also contain a conductive material such as a metal, a metal oxide, carbon and a conductive polymer.

The developer remaining after transfer is removed by a cleaning means 8. As a cleaning system, blade cleaning should be employed so that the construction of apparatus can be made simpler and more effective as the space for apparatus is saved. A blade cleaner usually takes a simple construction in which a platelike elastic member made of polyurethane or the like is brought into push contact with the surface of the photosensitive member in the direction of its generatrix. The blade cleaning elastic member may be brought into push contact in the direction including, e.g., the regular direction where the tip of a blade is directed in the direction of the rotation of the photosensitive member 1, the counter direction where the tip of a blade is directed toward the direction reverse to the direction of the rotation of the photosensitive member 1, and the direction where the blade is perpendicular to the photosensitive member. The blade may be not only provided alone but also used in combination with plural members. A cleaning brush, a web or a magnetic brush may also be used as an auxiliary means. The photosensitive member having been cleaned is subsequently subjected to charge elimination by means of a pre-exposure means 9.

Meanwhile, the transfer material to which the image has been transferred is separated from the photosensitive member and reaches an image fixing means 10, where the image is fixed and thereafter outputted to the outside of the machine. Reference numeral 11 denotes a tray that holds transfer materials P.

The present invention will be described below in greater detail by giving Examples.

EXAMPLE 1

In a solution prepared by dissolving 10 parts (parts by weight, the same applies hereinafter) of a phenol resin precursor (a resol type) in a mixed solvent of 10 parts of methanol and 10 parts of butanol, 10 parts of conductive titanium oxide (weight average particle diameter: 0.4 μm) whose particles had been coated with tin oxide was dispersed using a sand mill to produce a dispersion. The dispersion was applied to the surface of an aluminum cylinder of 80 mm in outer diameter and 360 mm in length by dip coating, followed by curing at 140° C. to form a conductive layer with a volume resistivity of $5\times10^9$ Ω.cm and a thickness of 20 μm.

Next, a solution prepared by dissolving 10 parts of methoxymethylated nylon (weight average molecular weight: 30,000, degree of methoxymethylation about 30%) represented by the formula:

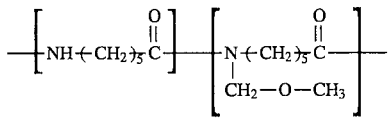

in 150 parts of isopropanol was applied to the surface of the above conductive layer by dip coating, followed by drying to form 8 subbing layer with a thickness of 1 μm.

Subsequently, in a solution prepared by dissolving 5 parts of a polycarbonate resin (weight average molecular weight: 30,000) represented by the formula:

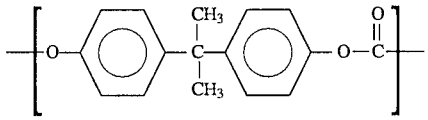

in 700 parts of cyclohexanone, 10 parts of an azo pigment represented by the formula:

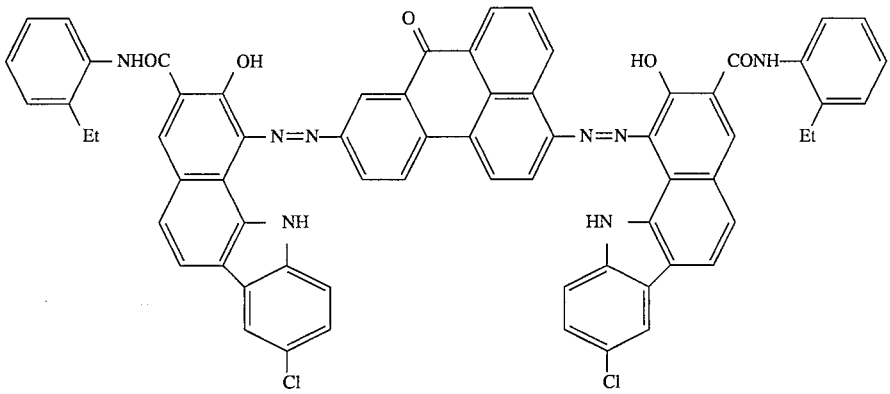

was dispersed using a sand mill to produce a dispersion. The dispersion was applied to the surface of the above subbing layer by dip coating, followed by drying to form a charge generation layer with a thickness of 0.05 μm.

Next, a solution prepared by dissolving 10 parts of a triphenylamine represented by the formula:

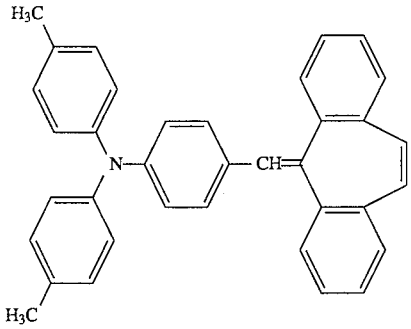

and 10 parts of a polycarbonate resin (weight average molecular weight: 20,000) represented by the formula:

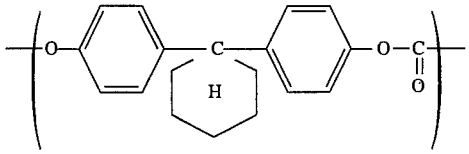

in a mixed solvent of 50 parts of monochlorobenzene and 15 parts of dichloromethane was applied to the surface of the above charge generation layer by dip coating, followed by hot-air drying to form a charge transport layer with a thickness of 20 μm.

Next, in a solution prepared by dispersing and dissolving 1 part of fine graphite fluoride powder (weight average particle diameter: 0.23 μm, available from Central Glass Co., Ltd.), 6 parts of a polycarbonate resin (weight average molecular weight: 80,000) represented by the formula:

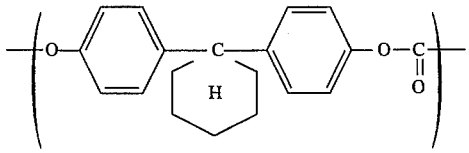

and 0.1 part of a perfluoroalkyl acrylate/methyl methacrylate block copolymer (weight average molecular weight: 30,000) represented by the formula:

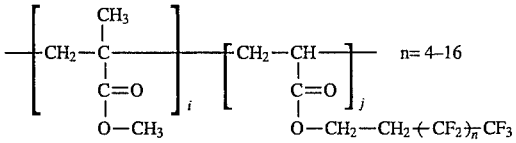

wherein i and j indicate a copolymerization ratio;

in a mixed solvent of 120 parts of monochlorobenzene and 80 parts of dichloromethane, 3 parts of a triphenylamine represented by the formula:

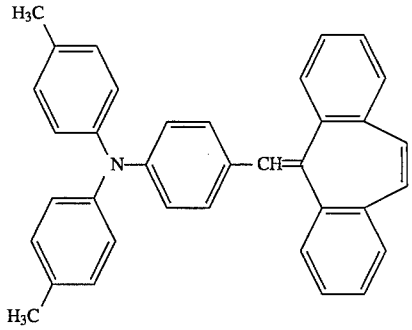

was dissolved to produce a solution. This solution was applied to the surface of the above charge transport layer by spray coating, followed by drying to form a protective layer with a thickness of 5 μm.

Performances of the electrophotographic photosensitive member thus obtained were evaluated by the methods shown below.

(F+Si)/C

Figure 5:
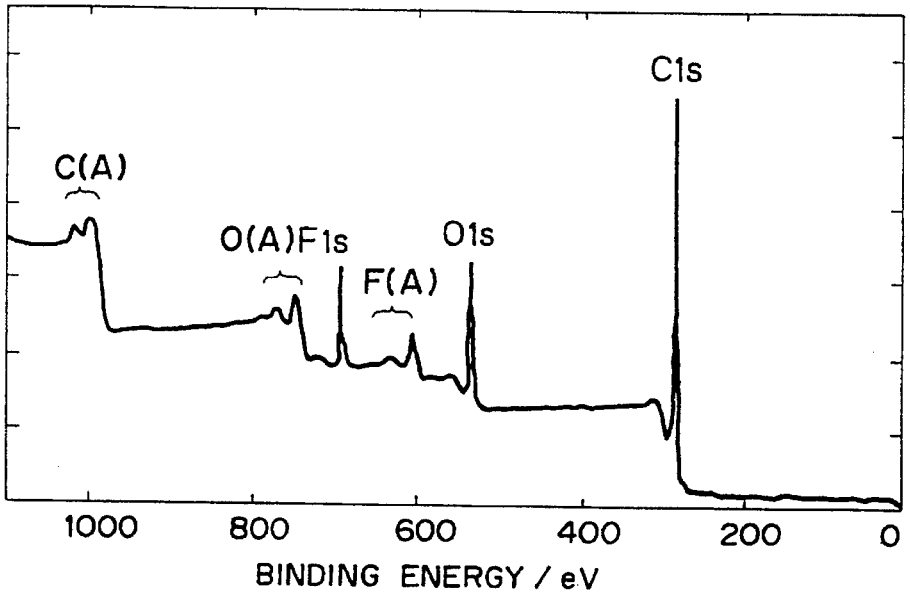
FIG. 5 shows a chart obtained by X-ray photoelectron spectroscopy of an electrophotographic photosensitive member produced in Example 1.

The photosensitive member was cut out in a size of 4 cm ×4 cm to obtain a sample. On this sample, surface elements were determined using an ESCALAB200-X type X-ray photoelectron spectroscope, manufactured by VG Co. As an X-ray source, MgCa (300 W) was used, and the measurement was made in a depth of several angstroms in a region of 2 mm ×3 mm. A chart thus obtained is shown in FIG. 5. As a result, fluorine atoms were in a content of 5.2%, silicon atoms 0% and carbon atoms 81.3% and (F+Si)/C was 0.064.

Contact angle

Contact angle to pure water, of the photosensitive member was measured using a dropping-type contact angle meter (manufactured by Kyowa Kaimen Kagaku K.K.). As a result, the contact angle of the photosensitive member of Example 1 was 108 degrees, showing a sufficiently low surface energy.

Transfer efficiency

The photosensitive member was set on the electrophotographic photosensitive member as shown in FIG. 1 and transfer efficiency at the initial stage was measured. Charging was carried out using a scorotoron with a negative polarity and exposure was carried out using a laser of 787 nm in wavelength. As a developer, a two-component developer with a negative polarity was used. Transfer was carried out using a corotoron with a positive polarity through a 100 μm thick polyethylene terephthalate film. To measure transfer efficiency, a halftone solid pattern was outputted in monochrome, where the density of the developer having been transferred to a transfer material and the density of the developer having remained on the photosensitive member were measured using a reflection type Macbeth densitometer, and then a calculation was made with a calculation formula: (transferred developer density)/(transferred developer density plus remaining developer density). Image density of the halftone solid pattern was made to be 0.80 as measured on the transfer material using the reflection type Macbeth densitometer. As a result, the transfer efficiency was as high as 93%.

Uneven transfer

The photosensitive member was set on the electrophotographic photosensitive member as shown in FIG. 1 and halftone solid pattern images obtained after four-color multiple transfer were outputted. Evaluation on images was made on images obtained after continuous output on 1,000 sheets. Image density of the halftone solid pattern images was made to be 1.20 on the average as measured using a reflection type Macbeth densitometer. As a result, uniform images were obtained.

Blank areas caused by faulty transfer

The photosensitive member was set on the electrophotographic photosensitive member as shown in FIG. 1 and lettering pattern images obtained after four-color multiple transfer: were outputted. Evaluation on images was made on images obtained after continuous output on 1,000 sheets. As a result, uniform lettering patterns were obtained even in lettering patterns after output on 1,000 sheets.

Drive pitch unevenness

The photosensitive member was set on the electrophotographic photosensitive member as shown in FIG. 1 and halftone solid pattern images obtained after four-color multiple transfer were outputted. Evaluation on images was made on images obtained after continuous output on 1,000 sheets. As a result, uniform patterns were obtained even in halftone solid patterns after output on 1,000 sheets.

Color misregistration

The photosensitive member was set on the electrophotographic photosensitive member as shown in FIG. 1 and gray halftone solid pattern images obtained after four-color multiple transfer were outputted. Evaluation on images was made on images obtained after continuous output on 1,000 sheets. As a result, patterns with uniform color tones were obtained even in gray halftone solid patterns after output on 1,000 sheets.

Comparative Example 1

An electrophotographic photosensitive member was produced in the same manner as in Example 1 except that the protective layer was not provided. Performance thereof was similarly evaluated.

Results obtained are shown below.

(F+Si)/C

Figure 7:
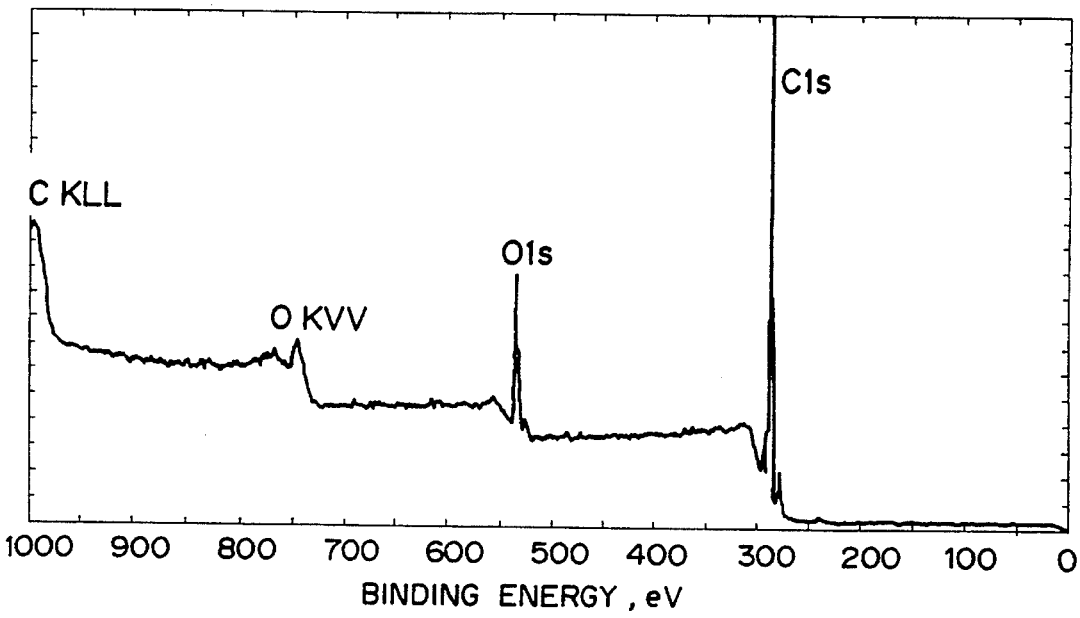
FIG. 7 shows a chart obtained by X-ray photoelectron spectroscopy of an electrophotographic photosensitive member produced in Comparative Example 1.

As shown in FIG. 7, fluorine atoms and silicon atoms were each in a content of 0%, and (F+Si)/C was 0.

Contact angle

Contact angle was 82 degrees.

Transfer efficiency

Transfer efficiency was 86%.

Uneven transfer

Blank areas caused by faulty transfer were partly seen, and images were greatly coarse and non-uniform.

Blank areas caused by faulty transfer

Figure 8:
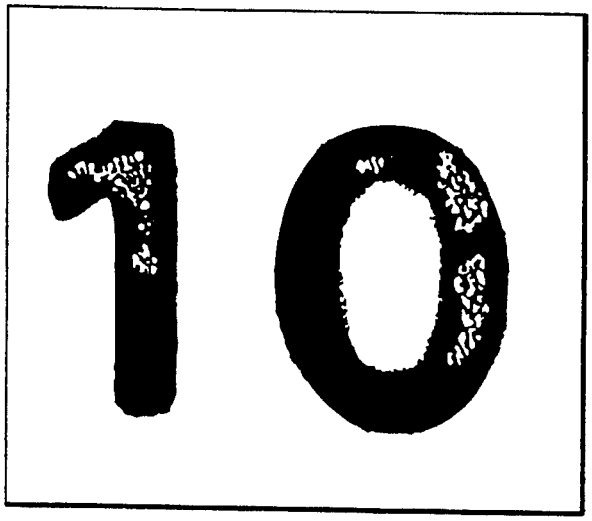
FIG. 8 shows an example of images in which blank areas caused by faulty transfer have occurred.

Blank areas caused by faulty transfer as shown in FIG. 8 were seen, where portions other than contours of lettering patterns came off because of faulty transfer.

Drive pitch unevenness

Irregular stripelike unevenness occurred in images in their directions of the rotation of the photosensitive member.

Color misregistration

Reddish color tone unevenness occurred in part. This outputted image was observed with a microscope to reveal that the magenta image among the four colors was misregistered by 50 to 90 μm in a dotlike image formed of four-color dots superimposed one another, showing that the uneven color tone was due to microscopic color misregistration.

EXAMPLE 2

Example 1 was repeated to form the conductive layer, the subbing layer and the charge generation layer on the aluminum cylinder.

Next, a charge transport layer was formed in the same manner as in Example 1 except that the triphenylamine used therein was replaced with a triphenylamine represented by the formula:

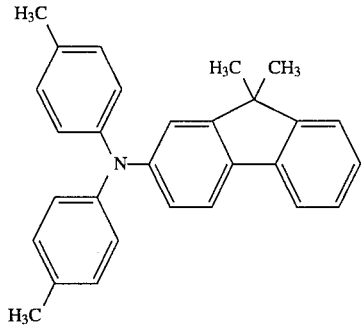

Next, in a solution prepared by dispersing and dissolving 3 parts of fine graphite fluoride powder (weight average particle diameter: 0.23 μm, available from Central Glass Co., Ltd.), 6 parts of a polycarbonate resin (weight average molecular weight: 80,000) represented by the formula:

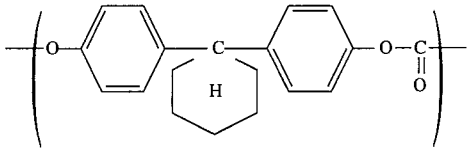

and 0.3 part of a perfluoroalkyl acrylate/methyl methacrylate block copolymer (weight average molecular weight: 30,000) represented by the formula:

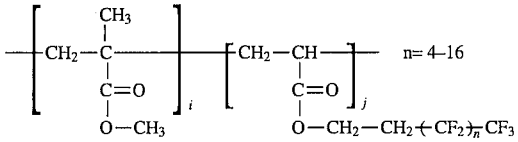

wherein i and j indicate a copolymerization ratio;

in a mixed solvent of 110 parts of monochlorobenzene and 80 parts of dichloromethane, 2.5 parts of a triphenylamine represented by the formula:

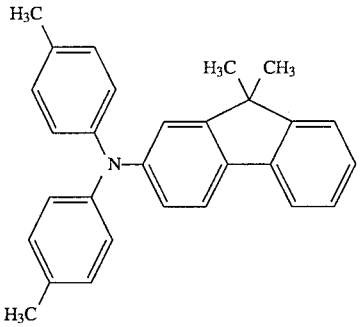

was dissolved to produce a solution. This solution was applied to the surface of the charge transport layer by spray coating, followed by drying to form a protective layer, with a thickness of 6 μm.

Performances of the electrophotographic photosensitive member thus obtained were evaluated in the same manner as in Example 1. As a result, the fluorine atoms were in a content of 10.2%, silicon atoms 0% and carbon atoms 76.7%, the (F+Si)/C was 0.13, and the contact angle was 113 degrees. The transfer efficiency was 96%, and very good images were obtainable without any uneven transfer, blank areas caused by faulty transfer, drive pitch unevenness and color misregistration.

EXAMPLE 3

Example 1 was repeated to form the conductive layer, the subbing layer and the charge generation layer on the aluminum cylinder.

Next, a charge transport layer was formed in the same manner as in Example 1 except that 10 parts of the triphenylamine used therein was replaced with 3 parts of a triphenylamine represented by the formula:

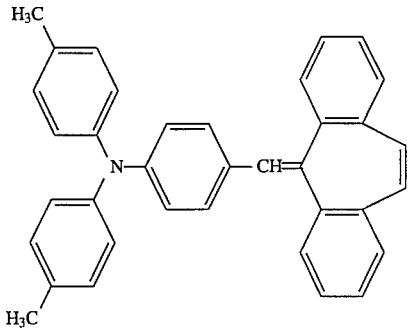

and 7 parts of a triphenylamine represented by the formula:

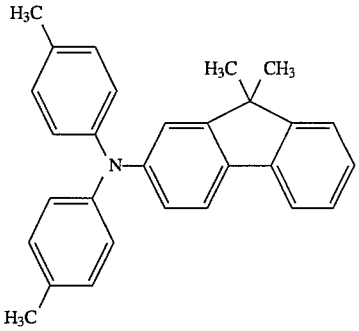

Next, in a solution prepared by dispersing and dissolving 3 parts of fine graphite fluoride powder (weight average particle diameter: 0.27 μm, available from Central Glass Co., Ltd.), 5.5 parts of a polycarbonate resin (weight average molecular weight: 80,000) represented by the formula:

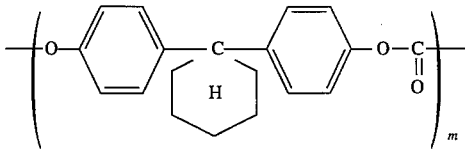

and 0.3 part of a fluorine atom-containing graft polymer (fluorine content: 27% by weight; weight average molecular weight: 25,000) represented by the formula:

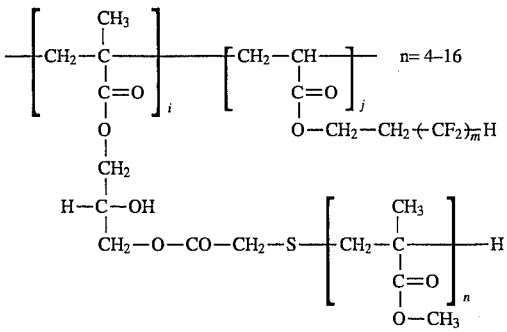

wherein i and j indicate a copolymerization ratio;

in a mixed solvent of 120 parts of monochlorobenzene and 80 parts of dichloromethane, 2.5 parts of a triphenylamine represented by the formula:

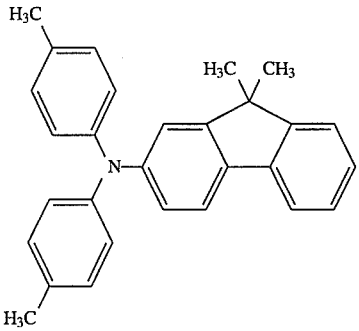

was dissolved to produce a solution. This solution was applied to the surface of the charge transport layer by spray coating, followed by drying to form a protective layer with a thickness of 4 μm.

Performances of the electrophotographic photosensitive member thus obtained were evaluated in the same manner as in Example 1. As a result, the fluorine atoms were in a content of 11.3%, silicon atoms 0% and carbon atoms 75.5%, the (F+Si)/C was 0.15, and the contact angle was 114 degrees. The transfer efficiency was 96%, and very good images were obtainable without any uneven transfer, blank areas caused by faulty transfer, drive pitch unevenness and color misregistration.

EXAMPLE 4

An electrophotographic photosensitive member was produced in the same manner as in Example 1 except that the fluorine atom-containing graft polymer used therein was replaced with the perfluoroalkyl acrylate/methyl methacrylate block copolymer as used in Example 1. Performances thereof were similarly evaluated.

As a result, the fluorine atoms were in a content of 12.2%, silicon atoms 0% and carbon atoms 73.2%, the (F+Si)/C was 0.17, and the contact angle was 115 degrees. The transfer efficiency was 95%, and very good images were obtainable without any uneven transfer, blank areas caused by faulty transfer, drive pitch unevenness and color misregistration.

EXAMPLE 5

Example 1 was repeated to form the conductive layer, the subbing layer and the charge generation layer on the aluminum cylinder.

Next, a solution prepared by dissolving 3 parts of a triphenylamine represented by the formula:

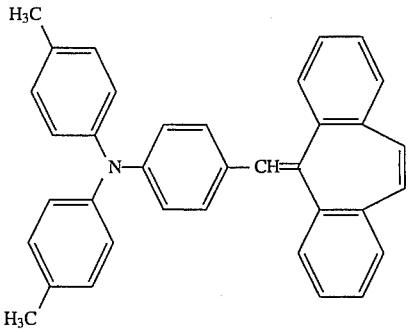

7 parts of a triphenylamine represented by the formula:

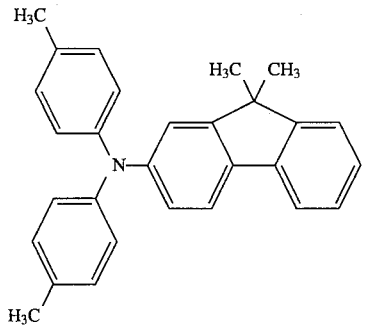

and 10 parts of a polycarbonate resin (weight average molecular weight: 25,000) represented by the formula:

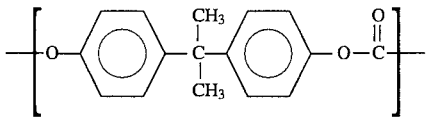

in a mixed solvent of 50 parts of monochlorobenzene and 15 parts of dichloromethane was applied to the surface of the charge generation layer by dip coating, followed by hot-air drying to form a charge transport layer with a thickness of 20 μm.

Next, in a solution prepared by dispersing and dissolving 3 parts of fine tetrafluoroethylene/hexafluoropropylene copolymer powder (monomer ratio: tetrafluoroethylene/hexafluoropropylene=3/7; an emulsion polymerization fine powder; weight average particle diameter: 0.32 μm, weight average molecular weight: 600,000), 5.5 parts of a polycarbonate resin (weight average molecular weight: 100,000) represented by the formula:

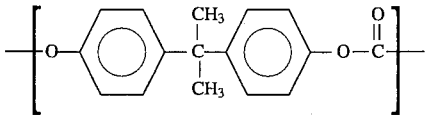

and 0.3 part of a perfluoroalkyl acrylate/methyl methacrylate block copolymer (weight average molecular weight: 30,000) represented by the formula:

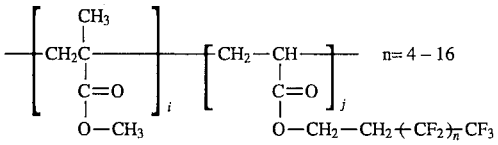

wherein i and j indicate a copolymerization ratio;

in a mixed solvent of 100 parts of monochlorobenzene and 70 parts of dichloromethane, 2.5 parts of a triphenylamine represented by the formula:

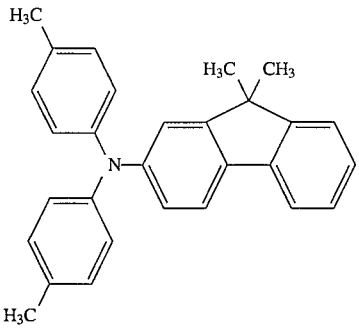

was dissolved to produce a solution. This solution was applied to the surface of the charge transport layer by spray coating, followed by drying to form a protective layer with a thickness of 5 μm.

Performances of the electrophotographic photosensitive member thus obtained were evaluated in the same manner as in Example 1. As a result, the fluorine atoms were in a content of 9.5%, silicon atoms 0% and carbon atoms 80.5%, the (F+Si)/C was 0.12, and the contact angle was 112 degrees. The transfer efficiency was 96% and very good images were obtainable without any uneven transfer, blank areas caused by faulty transfer, drive pitch unevenness and color misregistration.

Comparative Example 2

Example 1 was repeated to form the conductive layer, the subbing layer and the charge generation layer on the aluminum cylinder.

Next, a solution prepared by dissolving 10 parts of a triphenylamine represented by the formula:

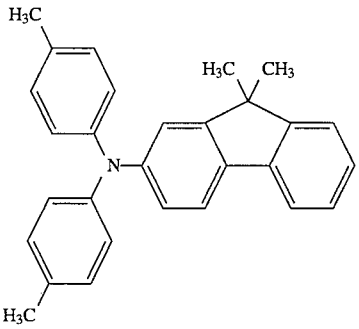

and 10 parts of a polycarbonate resin (weight average molecular weight: 25,000) represented by the formula:

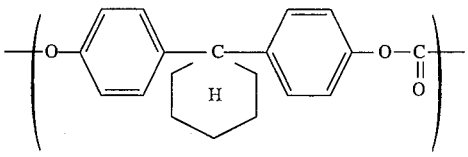

in a mixed solvent of 50 parts of monochlorobenzene and 15 parts of dichloromethane was applied to the surface of the charge generation layer by dip coating, followed by hot-air drying to form a charge transport layer with a thickness of 20 μm.

Next, in a solution prepared by dispersing and dissolving 0.3 part of fine graphite fluoride powder (weight average particle diameter: 0.27 μm, available from Central Glass Co., Ltd.), 6.4 parts of a polycarbonate resin (weight average molecular weight: 80,000) represented by the formula:

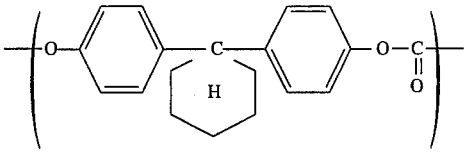

and 0.03 part of a perfluoroalkyl acrylate/methyl methacrylate block copolymer (weight average molecular weight: 30,000) represented by the formula:

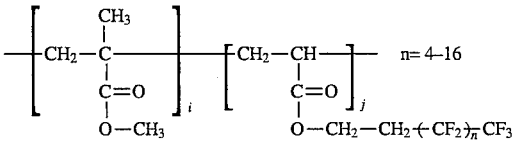

wherein i and j indicate a copolymerization ratio;

in a mixed solvent of 120 parts of monochlorobenzene and 80 parts of dichloromethane, 3.2 parts of a triphenylamine represented by the formula:

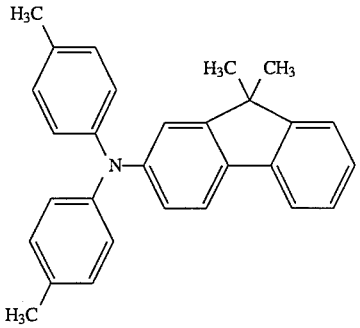

was dissolved to produce a solution. This solution was applied to the surface of the charge transport layer by spray coating, followed by drying to form a protective layer with a thickness of 5 μm.

Performances of the electrophotographic photosensitive member thus obtained were evaluated in the same manner as in Example 1. As a result, the fluorine atoms were in a content of 0.83%, silicon atoms 0% and carbon atoms 85.5% the (F+Si)/C was 0.0097, and the contact angle was 83 degrees. The transfer efficiency was 87%, and uneven transfer, blank areas caused by faulty transfer, drive pitch unevenness and color misregistration occurred.

EXAMPLE 6

Example 1 was repeated to form the conductive layer, the subbing layer, the charge generation layer and the charge transport layer on the aluminum cylinder.

Next, in a solution prepared by dispersing and dissolving 1 part of a truely spherical three-dimensional cross-linked fine polysiloxane particles (weight average particle diameter: 0.29 μm, available from Toshiba Silicone Co., Ltd.), 6 parts of a polycarbonate resin (weight average molecular weight: 80,000) represented by the formula:

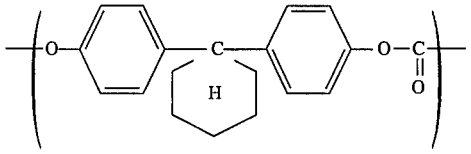

and 0.1 part of a polydimethylsiloxane methacrylate/methyl methacrylate block copolymer (silicon content: 22% by weight; weight average molecular weight: 50,000) represented by the formula:

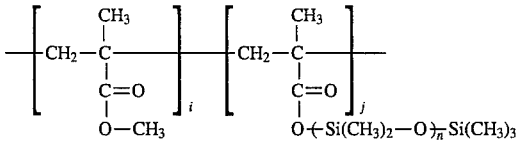

wherein i and j indicate a copolymerization ratio;

in a mixed solvent of 120 parts of monochlorobenzene and 80 parts of dichloromethane, 3 parts of a triphenylamine represented by the formula:

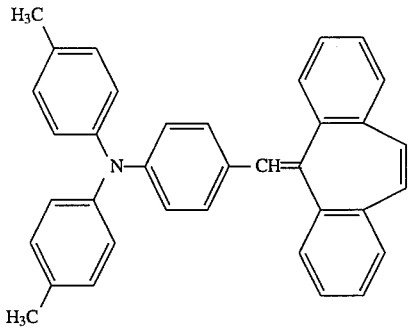

was dissolved to produce a solution. This solution was applied to the surface of the charge transport layer by spray coating, followed by drying to form a protective layer with a thickness of 3 μm.

Performances of the electrophotographic photosensitive member thus obtained were evaluated in the same manner as in Example 1.

(F+Si)/C

Figure 6:
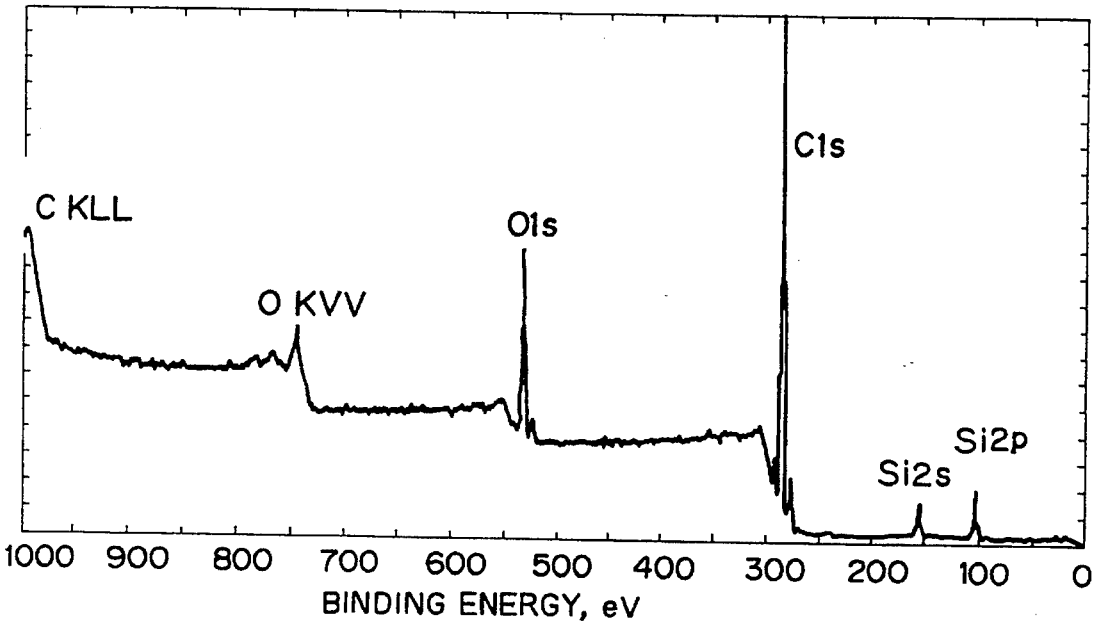
FIG. 6 shows a chart obtained by X-ray photoelectron spectroscopy of an electrophotographic photosensitive member produced in Example 6.

A chart obtained by X-ray photoelectron spectroscopy is shown in FIG. 6. As a result, the fluorine atoms were in a content of 0%, silicon atoms 10.2% and carbon atoms 62.3%, and the (F+Si)/C was 0.16.

Contact angle

Contact angle was 107 degrees.

Transfer efficiency

Transfer efficiency was 92%.

Uneven transfer

Like Example 1, uniform images were obtained.

Blank areas caused by faulty transfer

Like Example 1, uniform lettering patterns were obtained.

Drive pitch unevenness

Like Example 1, uniform patterns were obtained.

Color misregistration

Like Example 1, patterns with uniform color tones were obtained.

EXAMPLE 7

Example 2 was repeated to form the conductive layer, the subbing layer, the charge generation layer and the charge transport layer on the aluminum cylinder.

Next, in a solution prepared by dispersing and dissolving 3 parts of a truely spherical three-dimensional cross-linked fine polysiloxane particles (weight average particle diameter: 0.29 μm, available from Toshiba Silicone Co., Ltd.), 4 parts of a polycarbonate resin (weight average molecular weight: 80,000) represented by the formula:

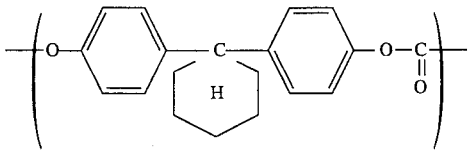

and 0.3 part of a polydimethylsiloxane methacrylate/styrene block copolymer (silicon content: 22% by weight; weight average molecular weight: 60,000) represented by the formula:

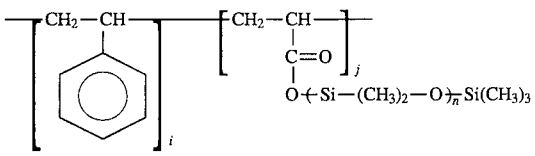

wherein i and j indicate a copolymerization ratio;

in a mixed solvent of 120 parts of monochlorobenzene and 80 parts of dichloromethane, 2.5 parts of a triphenylamine represented by the formula:

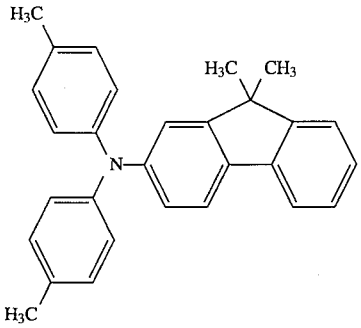

was dissolved to produce a solution. This solution was applied to the surface of the charge transport layer by spray coating, followed by drying to form a protective layer with a thickness of 3 μm.

Performances of the electrophotographic photosensitive member thus obtained were evaluated in the same manner as in Example 1. As a result, the fluorine atoms were in a content of 0%, silicon atoms 15.1% and carbon atoms 58.1%, the (F+Si)/C was 0.26, and the contact angle was 110 degrees. The transfer efficiency was 94%, and very good images were obtainable without any uneven transfer, blank areas caused by faulty transfer, drive pitch unevenness and color misregistration.

EXAMPLE 8

Example 3 was repeated to form the conductive layer, the subbing layer, the charge generation layer and the charge transport layer on the aluminum cylinder.

Next, in a solution prepared by dispersing and dissolving 3 parts of a truely spherical three-dimensional cross-linked fine polysiloxane particles (weight average particle diameter: 0.29 μm, available from Toshiba Silicone Co., Ltd.), 4 parts of a polycarbonate resin (weight average molecular weight: 80,000) represented by the formula:

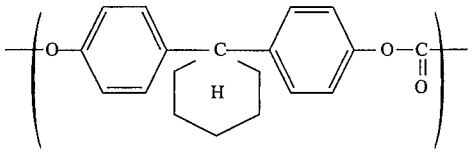

and 0.35 part of a silicon atom-containing graft copolymer (weight average molecular weight: 35,000) represented by the formula:

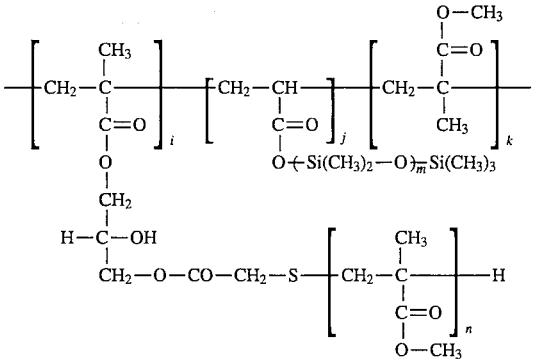

wherein i, j and k indicate a copolymerization ratio, and m and n each represent a positive integer;

in a mixed solvent of 120 parts of monochlorobenzene and 80 parts of dichloromethane, 2.5 parts of a triphenylamine represented by the formula:

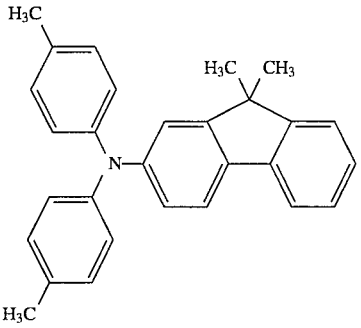

was dissolved to produce a solution. This solution was applied to the surface of the charge transport layer by spray coating, followed by drying to form a protective layer with a thickness of 3.5 μm.

Performances of the electrophotographic photosensitive member thus obtained were evaluated in the same manner as in Example 1. As a result, the fluorine atoms were in a content of 0%, silicon atoms 16.3% and carbon atoms 57.3%, the (F+Si)/C was 0.28, and the contact angle was 110 degrees. The transfer efficiency was 94%, and very good images were obtainable without any uneven transfer, blank areas caused by faulty transfer, drive pitch unevenness and color misregistration.

EXAMPLE 9

An electrophotographic photosensitive member was produced in the same manner as in Example 8 except that the silicon atom-containing graft polymer used therein was replaced with the polydimethylsiloxane acrylate/methyl methacrylate block copolymer as used in Example 6. Performances thereof were similarly evaluated.

As a result, the fluorine atoms were in a content of 0%, silicon atoms 15.6% and carbon atoms 58.5%, the (F+Si)/C was 0.27, and the contact angle was 110 degrees. The transfer efficiency was 94%, and very good images were obtainable without any uneven transfer, blank areas caused by faulty transfer, drive pitch unevenness and color misregistration.

Comparative Example 3

Comparative Example 2 was repeated to form the conductive layer, the subbing layer, the charge generation layer, and the charge transport layer on the aluminum cylinder.

Next, in a solution prepared by dispersing and dissolving 0.5 part of a truely spherical three-dimensional cross-linked fine polysiloxane particles (weight average particle diameter: 0.29 μm, available from Toshiba Silicone Co., Ltd.) and 4 parts of a polycarbonate resin (weight average molecular weight: 80,000) represented by the formula:

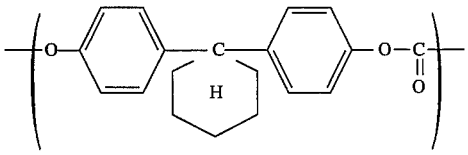

in a mixed solvent of 120 parts of monochlorobenzene and 80 parts of dichloromethane, 2.5 parts of a triphenylamine represented by the formula:

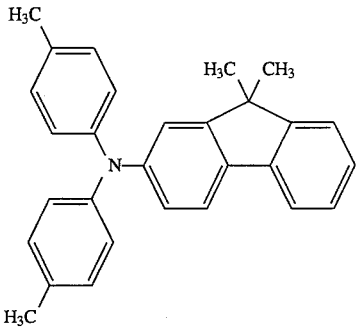

was dissolved to produce a solution. This solution was applied to the surface of the charge transport layer by spray coating, followed by drying to form a protective layer with a thickness of 3 μm.

Performances of the electrophotographic photosensitive member thus obtained were evaluated in the same manner as in Example 1. As a result, the fluorine atoms were in a content of 0.%, silicon atoms 0.53% and carbon atoms 83.3%, the (F+Si)/C was 0.0064, and the contact angle was 82 degrees. The transfer efficiency was 84%, and uneven transfer, blank areas caused by faulty transfer, drive pitch unevenness and color misregistration occurred.

What is claimed is:

1. An electrophotographic apparatus comprising an electrophotographic photosensitive member and a transfer means, wherein:

said electrophotographic photosensitive member comprises a conductive support having on its surface a photosensitive layer, and said electrophotographic photosensitive member has a surface layer comprising carbon atoms and at least one selected from the group consisting of fluorine atoms and silicon atoms, the proportion of fluorine atoms and silicon atoms to carbon atoms (F+Si)/C, in said surface layer as measured by X-ray photoelectron spectroscopy being from 0.01 to 1.0; and said transfer means transfers different colors one by one onto a transfer medium in a plurality of times.

2. An electrophotographic apparatus according to claim 1, wherein said surface layer contains carbon atoms and fluorine atoms in a proportion of fluorine atoms to carbon atoms, F/C, from 0.01 to 1.0.

3. An electrophotographic apparatus according to claim 1, wherein said surface layer contains carbon atoms and silicon atoms in a proportion of silicon atoms to carbon atoms, Si/C, from 0.01 to 1.0.

4. An electrophotographic apparatus according to claim 1, wherein said surface layer is the photosensitive layer.

5. An electrophotographic apparatus according to claim 1, wherein said surface layer is a protective layer formed on the photosensitive layer.

6. An electrophotographic apparatus according to claim 1, wherein an image transferred by said transfer means is an image formed by development of a dotlike electrostatic latent image.

* * * * *

UNITED STATES PATENT AND TRADEMARK OFFICE

CERTIFICATE OF CORRECTION

PATENT NO. : 5,485,250

DATED : January 16, 1996

INVENTOR(S) : NOBORU KASHIMURA ET AL.

It is certified that error appears in the above-identified patent and that said Letters Patent is hereby corrected as shown below:

ON TITLE PAGE

After item [73] insert
--[*] Notice: The portion of the term of this patent subsequent to Sep. 13, 2010 has been disclaimed--.

COLUMN 1

Line 45, ":such" should read --such--.

COLUMN 2

Line 1, "process," should read --process--.
Line 3, "has been questioned." should be deleted.
Line 54, "wherein;" should read --wherein:--.

COLUMN 4

Line 34, "later" should read --layer--.
Line 35, "later" should read --layer--.
Line 60, "azlenium" should read --azulenium--.
Line 62, "metter, qunoneimine" should read --matter, quinoneimine--.

UNITED STATES PATENT AND TRADEMARK OFFICE

CERTIFICATE OF CORRECTION

PATENT NO. : 5,485,250

DATED : January 16, 1996

INVENTOR(S) : NOBORU KASHIMURA ET AL.

It is certified that error appears in the above-identified patent and that said Letters Patent is hereby corrected as shown below:

COLUMN 5

Line 3, "end" should read --and--.
Line 53, "material" should read --materials--.
Line 67, "synchronized" should read --synchronized with--.

COLUMN 6

Line 13, "corotoron" should read --corotron-- and "scorotoron," should read --scorotron,--.
Line 49, "corotoron, a scorotoron," should read --corotron, a scorotron,--.

COLUMN 7

Line 44, "materials P." should read --materials.--.
Line 66, "methoxymethylation" should read --methoxymethylation:--.

COLUMN 8

Line 9, "8" should read --a--.

UNITED STATES PATENT AND TRADEMARK OFFICE

CERTIFICATE OF CORRECTION

PATENT NO. : 5,485,250

DATED : January 16, 1996

INVENTOR(S) : NOBORU KASHIMURA ET AL.

It is certified that error appears in the above-identified patent and that said Letters Patent is hereby corrected as shown below:

COLUMN 10

Line 18, "scorotoron" should read --scorotron--.
Line 22, "corotoron" should read --corotron--.
Line 50, "transfer:" should read --transfer--.

COLUMN 11

Line 36, "superimposed" should read --superimposed upon--.

COLUMN 12

Line 44, "layer," should read --layer--.

COLUMN 13

Line 54, "—H" should read -- —$CF_3$--.

UNITED STATES PATENT AND TRADEMARK OFFICE

CERTIFICATE OF CORRECTION

PATENT NO. : 5,485,250

DATED : January 16, 1996

INVENTOR(S) : NOBORU KASHIMURA ET AL.

It is certified that error appears in the above-identified patent and that said Letters Patent is hereby corrected as shown below:

COLUMN 16

Line 25, "96%" should read --96%,--.

Signed and Sealed this

Twenty-ninth Day of October 1996

*Attest:*

*Attesting Officer*

BRUCE LEHMAN

*Commissioner of Patents and Trademarks*